US008635992B2

(12) United States Patent
Bernhaupt

(10) Patent No.: US 8,635,992 B2
(45) Date of Patent: Jan. 28, 2014

(54) METHOD FOR CONTROLLING THE TEMPERATURE OF AN INJECTOR OF AN INJECTION SYSTEM FOR INJECTING FUEL INTO THE COMBUSTION CHAMBER OF AN INTERNAL COMBUSTION ENGINE

(75) Inventor: Martin Bernhaupt, Oberalm (AT)

(73) Assignee: Robert Bosch GmbH, Stuttgart-Feuerbach (DE)

( * ) Notice: Subject to any disclaimer, the term of this patent is extended or adjusted under 35 U.S.C. 154(b) by 0 days.

(21) Appl. No.: 13/522,910

(22) PCT Filed: Jan. 18, 2011

(86) PCT No.: PCT/AT2011/000031

§ 371 (c)(1), (2), (4) Date: Jul. 18, 2012

(87) PCT Pub. No.: WO2011/088490

PCT Pub. Date: Jul. 28, 2011

(65) Prior Publication Data

US 2012/0291759 A1 Nov. 22, 2012

(30) Foreign Application Priority Data

Jan. 19, 2010 (AT) ..... A 64/2010

(51) Int. Cl.
*F02G 5/00* (2006.01)

(52) U.S. Cl.
USPC ..... 123/543; 123/445

(58) Field of Classification Search
USPC ..... 123/445–446, 456, 457–461, 510–511, 123/514, 543, 553, 557; 239/5, 88–90, 239/95–96, 124, 127, 132, 132.1, 132.5, 239/585.1
See application file for complete search history.

(56) References Cited

U.S. PATENT DOCUMENTS

| | | | | |
|---|---|---|---|---|
| 2,747,555 | A * | 5/1956 | Brunner | 123/445 |
| 3,067,581 | A * | 12/1962 | Reggio | 60/39.281 |
| 4,372,278 | A * | 2/1983 | Smith | 123/557 |
| 4,377,149 | A * | 3/1983 | Naylor et al. | 123/557 |

(Continued)

FOREIGN PATENT DOCUMENTS

| | | | |
|---|---|---|---|
| DE | 3119050 | A1 | 11/1982 |
| DE | 10358266 | A1 | 8/2005 |

(Continued)

OTHER PUBLICATIONS

International Search Report dated Apr. 8, 2011 (and WIPO translation), issued in International Application PCT/AT2011/000031.

(Continued)

*Primary Examiner* — Hung Q Nguyen
(74) *Attorney, Agent, or Firm* — Fitch, Even, Tabin & Flannery LLP

(57) ABSTRACT

A method for controlling the temperature of an injector of an injection system for injecting fuel into the combustion chamber of an internal combustion engine during the standstill of the internal combustion engine involves branching off a partial amount of the fuel as flush volume between a pre-supply pump and a high-pressure pump; conducting it through a heat exchanger for heating the fuel; and feeding the heated fuel to a high-pressure fuel storage (inside the injector) so that the flush volume flows through the high-pressure fuel storage to prevent fuel from solidifying.

14 Claims, 2 Drawing Sheets

(56) References Cited

U.S. PATENT DOCUMENTS

Figure 1:
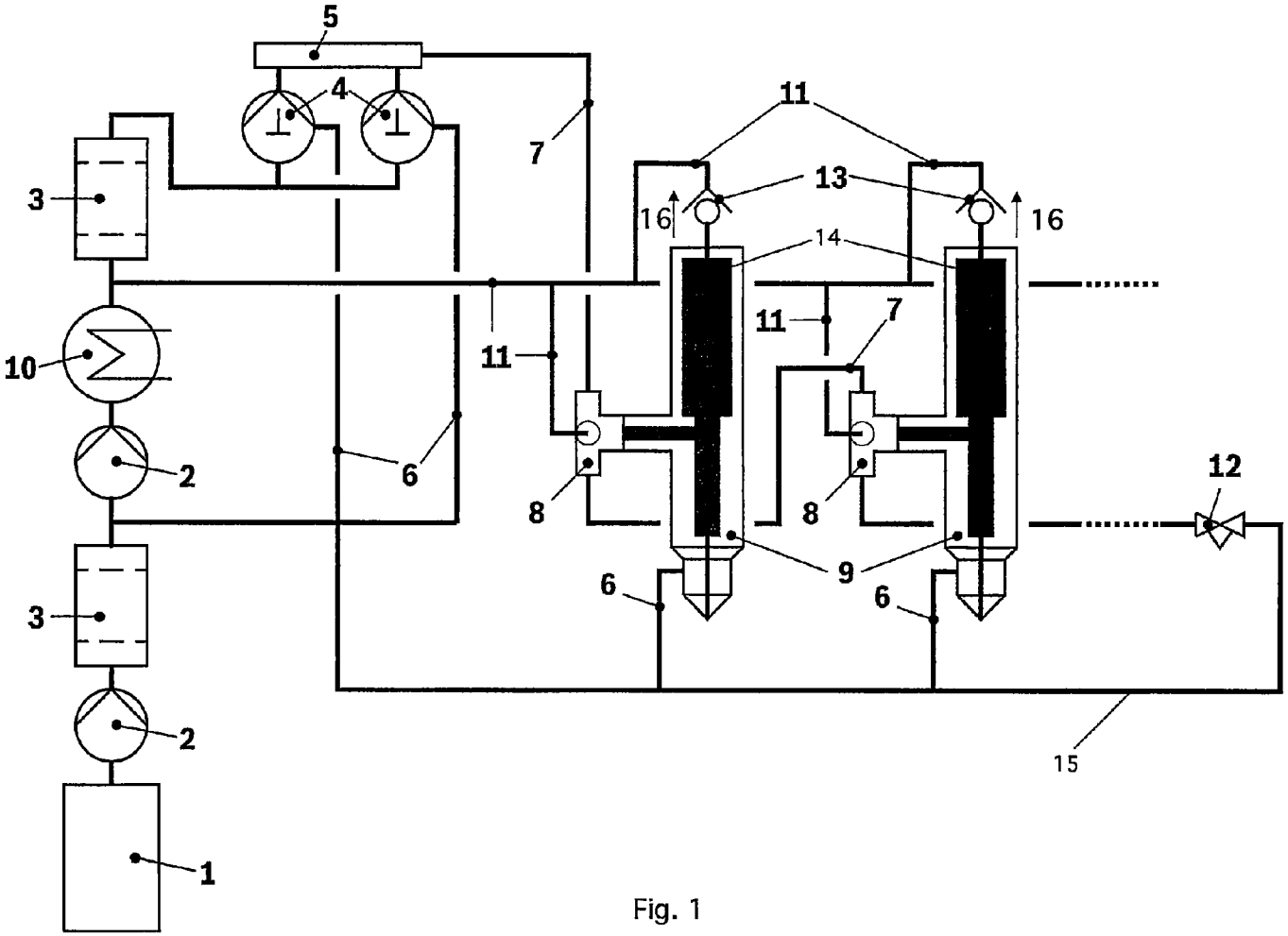

| | | | | | |
|---|---|---|---|---|---|
| 4,411,239 | A | * | 10/1983 | Kelch | 123/557 |
| 4,440,138 | A | * | 4/1984 | Smith | 123/557 |
| 4,625,701 | A | * | 12/1986 | Bartlett et al. | 123/514 |
| 4,770,150 | A | * | 9/1988 | Fraenkle et al. | 123/510 |
| 5,794,598 | A | * | 8/1998 | Janik et al. | 123/514 |
| 2010/0102143 | A1 | | 4/2010 | Magel | |
| 2011/0186647 | A1 | | 8/2011 | Bernhaupt et al. | |

FOREIGN PATENT DOCUMENTS

| | | | | | |
|---|---|---|---|---|---|
| GB | 2123086 | A | * | 1/1982 | F02M 53/02 |
| GB | 2 097 858 | A | | 11/1982 | |
| WO | 98/44255 | A1 | | 10/1998 | |
| WO | 2006/081829 | A1 | | 8/2006 | |
| WO | 2008110406 | A1 | | 9/2008 | |
| WO | 2009023887 | A1 | | 2/2009 | |

OTHER PUBLICATIONS

International Preliminary Examination Report, issued in International Application PCT/AT2011/000031, Jul. 24, 2012.

* cited by examiner

METHOD FOR CONTROLLING THE TEMPERATURE OF AN INJECTOR OF AN INJECTION SYSTEM FOR INJECTING FUEL INTO THE COMBUSTION CHAMBER OF AN INTERNAL COMBUSTION ENGINE

CROSS-REFERENCE TO RELATED APPLICATIONS

This is a U.S. National Phase of International Application PCT/AT2011/000031, filed Jan. 18, 2011, and claims the benefit of foreign priority from Austrian Patent Application A 64/2010, filed Jan. 19, 2010, the entire disclosures of which applications are hereby incorporated herein by reference.

The present invention relates to a method for controlling the temperature of an injector of an injection system for injecting fuel into the combustion chamber of an internal combustion engine, in which the fuel is pumped by at least one pre-supply pump from a tank to at least one high-pressure pump, and the high-pressure fuel pumped by the high-pressure pump is fed to the injector, wherein a high-pressure fuel storage is arranged inside the injector and the injector includes an injection nozzle having a nozzle needle that is axially displaceable in a nozzle pre-chamber, which nozzle needle is immersed in a control chamber that can be fed with high-pressure fuel and whose pressure is controlled by a control valve opening or closing at least one inlet or outlet channel for fuel, and a device for carrying out said method.

Injectors of the initially described type are frequently used in common-rail injection systems. Injectors for common-rail systems for injecting high-viscosity fuels into the combustion chamber of an internal combustion engine are known in various configurations. In the event of heavy oil, heating up to 150° C. is required to attain the necessary injection viscosity.

Basically, an injector for a common-rail injection system comprises different parts which, as a rule, are held together by a nozzle clamping nut. The injector nozzle proper includes a nozzle needle, which is guided within the nozzle body of the injector nozzle in an axially displaceable manner and has several open spaces through which fuel is able to flow from the nozzle pre-chamber to the tip of the needle. The nozzle needle itself carries a collar supporting a pressure spring and reaches into a control chamber capable of being fed with a pressurized fuel. To this control chamber can be connected an inlet channel via an inlet throttle and an outlet channel via an outlet throttle, the respective pressure built up within the control chamber together with the force of the pressure spring keeping the nozzle needle in the closed position. The pressure prevailing in the control chamber is controllable by a control valve, which in most cases is actuated by an electromagnet. If appropriate wiring is provided, the opening of the magnetic valve will cause the drainage of fuel via a throttle such that a reduction of the hydraulic holding force on the nozzle needle end face reaching into the control chamber will cause the opening of the nozzle needle. In this manner, fuel will subsequently be able to enter the combustion chamber of the motor through the injection openings.

In addition to an outlet throttle, an inlet throttle is also provided in most cases, wherein the opening speed of the nozzle needle is determined by the flow difference between inlet and outlet throttles. With the magnetic valve closed, the outlet path of the fuel is blocked by the outlet throttle and pressure is newly built up in the control chamber via the inlet throttle, thus causing the closure of the nozzle needle.

From WO 2009/023887, a method and device for injecting fuel into the combustion chamber of an internal combustion engine have become known, in which the injector for injecting fuel into the combustion chamber can be preheated with moderate-temperature fuel. This may, for instance, become necessary if the internal combustion engine is operated with heavy fuel, as is frequently the case with large-volume diesel engines. Such heating of the injectors is necessary, because the heavy fuel would become thick or viscous inside the injectors and lines due to the temperature decrease at a standstill of the internal combustion engine, and the injectors and lines would, as a result, be obstructed by the solidified fuel, with a restart of the internal combustion engine being not readily possible.

In the method according to WO 2009/023887, a partial amount of the fuel is, therefore, withdrawn between the pre-supply pump and the high-pressure pump of the injection system, conducted through a heat exchanger and fed as flush volume to the control valve via a separate channel provided in the injector, so that the flush volume flows through the armature chamber of the control valve, thus keeping the same at a certain elevated temperature.

The injectors to be used according to WO 2009/023887 operate according to the common-rail principle, according to which fuel in a common high-pressure fuel storage, i.e. the common rail, is maintained at a high pressure, wherein the injectors are connected to the common rail via high-pressure lines and, upon actuation of the control valve in the respective injector, lifting of the nozzle needle from the valve seat and hence injection into the combustion chamber are caused in the respective injector, the respective injection volume being provided by the common rail. With particularly large engines, in which the individual injectors are possibly arranged at considerable mutual distances, the use of a common rail for the injectors does not make sense, since the lengths of the lines from the rail to the injectors would have to be very long on account of the size of the engine, so that a high pressure drop would result during injection. With such engines, in which the movement of the nozzle needle for opening and closing the injection nozzles is, however, also controlled by the pressure exerted on the valve seat of the nozzle needle and the pressure that is controllable by a control valve in a control chamber on the inner needle facing away from the injection nozzles, it is, therefore, provided to arrange a high-pressure fuel storage inside the injector. Such a mode of construction is referred to as a modular structure, since each individual injector has its own high-pressure fuel storage and can thus be used as an independent module. High-pressure fuel storage in this case does not imply an ordinary line, but high-pressure fuel storage rather denotes a pressure-proof container having a supply line and a discharge line, the diameter of which container is considerably enlarged relative to high-pressure lines in order to enable a specific injection volume to be delivered from the high-pressure fuel storage without causing an immediate pressure drop, as would be the case if the injection amount were taken from an ordinary high-pressure line. In addition to the injection volume, a control volume that is delivered to the low-pressure region through the opened control valve controlling the pressure in the control chamber on the control needle end facing away from the injection nozzles will occur in such pressure-controlled injectors.

If, as in the prior art, an appropriately temperature-controlled flush volume is merely supplied to the control valve for heating the injector during the standstill of the internal combustion engine, it will not be possible to keep the fuel volume in the relatively largely dimensioned high-pressure fuel storage at a sufficiently large temperature to safely prevent the solidification of the fuel in the high-pressure fuel storage and in the other components of the injector.

The object of the present invention, therefore, resides in providing a method and a device which enable the fuel present in the injectors of an internal combustion engine having a modular structure to be prevented from solidifying. To solve this object, the method of the initially mentioned type according to the invention is further developed to the effect that, during the standstill of the internal combustion engine, a partial amount of the fuel is branched off as flush volume between the pre-supply pump and the high-pressure pump, is conducted through a heat exchanger for heating the fuel, and is fed to the high-pressure fuel storage, so that the flush volume flows through the high-pressure fuel storage. During a standstill of the internal combustion engine, the high-pressure pumps are idle, and the pressure in the system drops to below the pre-supply pressure of the pre-supply pump such that the pressure of the pre-supply pump will do to pump fuel into the high-pressure fuel storage. According to the invention, the fuel provided to this end is withdrawn between the pre-supply pump and the high-pressure pump, heated in a heat exchanger, and directly fed to the high-pressure fuel storage. The high-pressure fuel storage constitutes a relatively large volume inside the injector such that the whole injector will be sufficiently heated if the high-pressure fuel storage is maintained at the appropriate temperature.

Since in large diesel engines operated with heavy oil, also relatively long line paths will naturally result, the invention is advantageously further developed to the effect that the fuel is brought to an overpressure of 5-10 bar by the pre-supply pump such that pressure losses due to the line lengths will be safely eliminated, and reliable flushing and, hence, tempering of all injectors will be ensured.

Following the introduction of the tempered fuel into the high-pressure fuel storage, the former has to be able to flow off the injector. In this respect, it is preferably proceeded in a manner that the flush volume is discharged from the injector via connections for high-pressure fuel lines of the injection system. The high-pressure fuel lines, which are not under high pressure during a standstill of the internal combustion engine as already pointed out above, in an internal combustion engine having a modular structure are connected to the low-pressure region of the injection system, optionally via an interposed collecting main, so that the flush volumes can be discharged through these lines.

In this respect, it is preferably proceeded in a manner that the flush volume is returned to the tank or to the pre-supply pump such that even in this case an accordingly high temperature level will be maintained in order to prevent the obstruction of lines in this region.

At a standstill, the temperature of the internal combustion engine will continuously decrease such that the amount of heat to be introduced into the injector for maintaining the fluidity of the fuel will increase with the period of standstill. No supply at all of flush volume will be required until a certain limit temperature since the engine will be sufficiently hot to keep the fuel liquid, wherein, when falling below said limit temperature, heating will become necessary and the branched-off flush volume will have to be increased over time in order compensate for the constantly decreasing temperatures of the internal combustion engine in the injector. The method according to the invention is, therefore, advantageously further developed to the effect that the flush volume branched off between the pre-supply pump and the high-pressure pump is controlled.

According to a preferred embodiment of the present invention, it is provided that a further flush volume is directly supplied to the control valve of the injector such that, besides the high-pressure fuel storage, which usually communicates with the nozzle pre-chamber and forms the high-pressure side of the injector together with the former, also the low-pressure side of the injector, which is formed by the control valve and the associated drains from the control valve, will be kept at an elevated temperature by an accordingly tempered flush volume. This may, in particular, be necessary with especially large-sized injectors in order to enable the entire injector to be kept sufficiently warm.

When the internal combustion engine is again put into operation after a standstill phase, and the high-pressure pump also starts running again for that purpose, the pressure in the high-pressure fuel storage will considerably increase such that a pressure loss would occur over the branch line for the flush volume. The method according to the invention is, therefore, advantageously further developed to the effect that the supply line for the flush volume to the high-pressure fuel storage is closed by a non-return valve during the operation of the internal combustion engine.

The device for injecting fuel into the combustion chamber of an internal combustion engine for carrying out the method according to the invention comprises at least one pre-supply pump for supplying fuel from a tank, at least one high-pressure pump, and at least one injector, wherein the fuel supplied by the pre-supply pump is fed to the high-pressure pump and the high-pressure fuel supplied by the high-pressure pump is fed to the injector, a high-pressure fuel storage is arranged inside the injector, and the injector includes an injection nozzle having a nozzle needle that is axially displaceable in a nozzle pre-chamber, which nozzle needle is immersed in a control chamber that can be fed with high-pressure fuel and whose pressure is controlled by a control valve opening or closing at least one inlet or outlet channel for fuel. Such injection systems are referred to as modular common-rail systems, since the individual injectors are each equipped with their own high-pressure fuel storage, which assumes the function of the rail, with the injection otherwise occurring as in conventional injectors of common-rail engines. As already pointed out above, the pressure of the high-pressure fuel storage is constantly applied to the nozzle pre-chamber, in which an axially displaceable nozzle needle closes the injection nozzles, wherein, on the nozzle needle end facing away from the injection nozzles, a control chamber is arranged, which is optionally also under this pressure, which can be temporarily relaxed by the actuation of a control valve. When the control pressure in the control chamber drops, the opening forces acting on the nozzle needle are larger than the closing forces such that the injection holes will be cleared. In such a device, it is now provided according to the invention that a branch line for a flush volume is connected between the at least one pre-supply pump and the at least one high-pressure pump, said branch line leading through a heat exchanger and opening into the high-pressure fuel storage of the injector, so that the flush volume flows through the high-pressure fuel storage. This measure enables the high-pressure fuel storage to be kept at a sufficiently high temperature to prevent the fuel from solidifying.

In order to overcome pressure losses occurring in the relatively long lines in large engines, the device according to the invention is advantageously further developed to the effect that the pre-supply pump for supplying the fuel is designed for 5-10 bar.

A particularly preferred way of discharging the supplied flush volume from the injector can be achieved in that a T-piece is connected to the injector to connect high-pressure lines with the high-pressure fuel storage and/or the nozzle pre-chamber of a first injector and the T-piece of a further injector so as to allow discharging of the flush volume via the high-pressure lines for the high-pressure fuel that is required during the operation of the internal combustion engine.

To heat the pre-supply pump with the residual heat of the flush volume, the device according to the present invention is preferably further developed to the effect that low-pressure lines for returning the flush volume to the pre-supply pump are provided.

In order to enable the control of the flush volume independently of the pump speed of the pre-supply pump, the device is preferably further developed to the effect that a throttle and/or a control valve is/are arranged in the branch line for controlling the flush volume.

If the injector is designed to be particularly large, it may be advantageous to not only warm up the high-pressure fuel storage with a flush volume, but to also heat the low-pressure side of the injector. To this end, the device according to the invention can be further developed to the effect that a connection directly communicating with the control valve of the injector is provided on the injector for a further flush volume.

In order to prevent a pressure loss through the branch line during the operation of the internal combustion engine, which causes a strong increase of the pressure in the high-pressure fuel storage, the device according to the invention can advantageously be further developed to the effect that a non-return valve is arranged in the branch line for the flush volume, which closes against the supply direction for the flush volume.

In the following, the invention will be explained in more detail by way of an exemplary embodiment schematically illustrated in the drawing.

Figure 2:
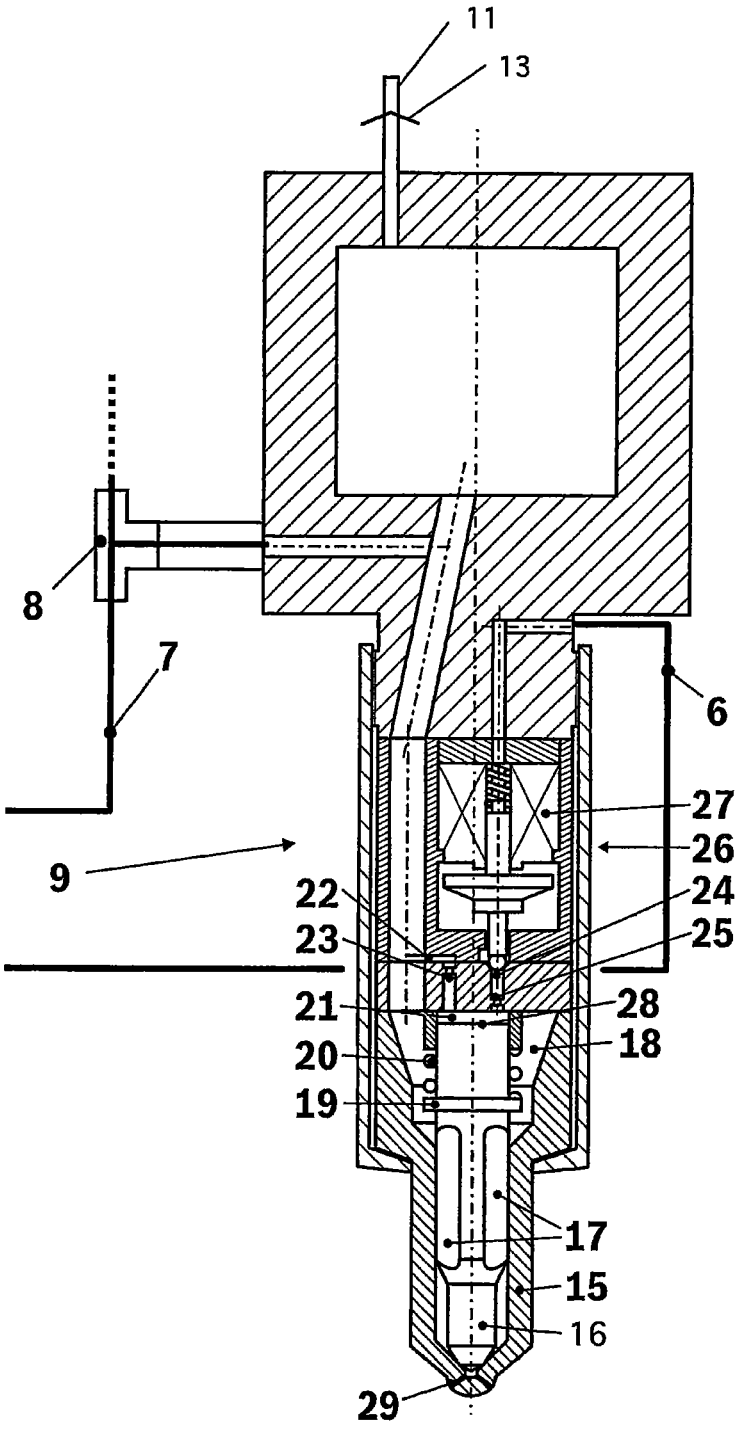

Therein, FIG. 1 illustrates the schematic structure of an injection system according to the invention for performing the method of the invention; and FIG. 2 is a detailed schematic illustration of an injector as used in the present invention.

In FIG. 1, a fuel tank is denoted by 1, from which fuel is conveyed via a pre-supply pump 2 and a filter 3 to a further pre-supply pump 2. During normal operation of the engine, the fuel is fed via a further filter 3 to high-pressure pumps 4, which supply the fuel to a collector 5. Low-pressure lines, which are denoted by 6, return the leak fuel occurring during the high-pressure supply into the low-pressure region of the injection system. The high-pressure fuel is fed to the schematically illustrated injectors 9 via high-pressure lines 7 and T-pieces 8, the high-pressure fuel storage of the injectors 9 being denoted by 14.

If, at a standstill of the engine, the temperature drops and the heavy oil in the lines and in the injectors threatens to solidify, the fuel is branched off via a branch line 11 downstream of the second pre-supply pump 2 and the heat exchanger 10 upstream of the high-pressure pumps, and is fed to the high-pressure fuel storages 14 of the individual injectors 9. Drainage of the flush volume takes place via the high-pressure lines 7, which open into a common collecting main 15, wherein the high-pressure region is separated from the low-pressure region by the flush valve 12. Alternatively, or additionally, a flush volume can also be supplied, via the lines and the T-pieces 8, to the low-pressure region of the injectors 9, which is formed by the control valve and the associated discharge lines, the respective drain channel subsequently running into the low-pressure region, for instance into the collecting main 15, of the injection system via the low-pressure lines 6.

When the pre-supply pumps 2 start running again with the engine operating, the pressure in the high-pressure fuel storages 14 will strongly increase such that a backflow via lines 11 and hence a pressure loss would occur. To prevent this, a schematically illustrated non-return valve 13 is arranged in the region where the branch lines 11 open into the high-pressure fuel storages of the injectors, which non-return valve closes in the sense of arrow 16 to prevent the backflow of high-pressure fuel through the branch line 11. A similar valve can also be disposed in the T-piece 8.

As can be seen from FIG. 2, the injector nozzle proper includes a nozzle needle 16 which is guided within the nozzle body 15 of the injector 9 in an axially displaceable manner and comprises several open spaces 17, through which fuel can flow from the nozzle pre-chamber 18 to the tip of the needle. The nozzle needle 16 itself carries a collar 19, on which a compression spring 20 is supported, and is immersed in a control chamber 21, to which fuel under pressure can be fed. To this control chamber 21 are connected an inlet channel 22 via an inlet throttle 23 and an outlet channel 24 via an outlet throttle 25, the respective pressure built up in the control chamber 21 together with the force of the compression spring 20 holding the nozzle needle 16 in the closing position. The pressure in the control chamber 21 is controlled by a control or magnetic valve 26 which is actuated by an electromagnet 27. Opening of the magnetic valve 26 causes a drainage of the fuel through the outlet throttle 25 such that the decline of the hydraulic holding force acting on the end face 28 immersed in the control chamber 21, of the nozzle needle 16 causes the nozzle needle 16 to open. In this manner, the fuel reaches the combustion chamber of the engine through the injection openings 29.

In addition to the outlet throttle 25, an inlet throttle 23 is provided, wherein the opening speed of the nozzle needle 16 is determined by the flow difference between the inlet and outlet throttles. When the magnetic valve 26 is closed, the outlet path of the fuel through the outlet throttle 25 is blocked, and pressure is again built up in the control chamber 21 via the inlet throttle 23, thus causing the nozzle needle 16 to close. The remaining reference numerals have been taken over from FIG. 1.

The invention claimed is:

1. A method for controlling a temperature of an injector of an injection system for injecting fuel into a combustion chamber of an internal combustion engine, comprising pumping fuel by at least one pre-supply pump from a tank to at least one high-pressure pump, pumping the high-pressure fuel from the high-pressure pump and feeding it to the injector, wherein said injector includes a high-pressure fuel storage arranged inside the injector, a nozzle pre-chamber, a control chamber, an injection nozzle having a nozzle needle that is axially displaceable in the nozzle pre-chamber, wherein the nozzle needle is immersed in the control chamber fed with high-pressure fuel and wherein a pressure of the control chamber is controlled by a control valve opening or closing at least one inlet or outlet channel for fuel, wherein during the standstill of the internal combustion engine, said method comprises branching off a partial amount of the fuel as a flush volume between the pre-supply pump and the high-pressure pump, conducting that partial amount of fuel through a heat exchanger for heating the fuel, and feeding it to the high-pressure fuel storage, so that the flush volume flows through the high-pressure fuel storage.

2. A method according to claim 1, wherein said method further comprises bringing the fuel to an overpressure of 5-10 bar by the pre-supply pump.

3. A method according to claim 1, wherein said method further comprise discharging the flush volume from the injector via connections for high-pressure fuel lines of the injection system.

4. A method according to claim 1, wherein said method further comprises returning the flush volume to the tank or to the pre-supply pump.

5. A method according to claim 1, wherein said method further comprises controlling the flush volume branched off between the pre-supply pump and the high-pressure pump.

6. A method according to claim 1, wherein said method further comprises directly supplying a further flush volume to the control valve of the injector.

7. A method according to claim 1, wherein said method further comprises closing a supply line for the flush volume to the high-pressure fuel storage by a non-return valve during the operation of the internal combustion engine.

8. A device for injecting fuel into a combustion chamber of an internal combustion engine comprising at least one pre-supply pump for supplying fuel from a tank; at least one high-pressure pump and at least one injector, wherein the fuel supplied by the pre-supply pump is fed to the high pressure pump and the high-pressure fuel supplied by the high-pressure pump is fed to the injector, a high-pressure fuel storage is arranged inside the injector and the injector includes a nozzle pre-chamber, an injection nozzle having a nozzle needle that is axially displaceable in the nozzle pre-chamber, a control chamber, wherein the nozzle needle is immersed in the control chamber fed with the high-pressure fuel; a control valve for controlling the pressure of the control chamber by opening or closing at least one inlet or outlet channel for fuel; a branch line for a flush volume connected between the at least one pre-supply pump and the at least one high-pressure pump; the heat exchanger; said branch line leading through a heat exchanger and opening into the high-pressure fuel storage of the injector so that the flush volume flows through the high-pressure fuel storage.

9. A device according to claim 8, wherein the pre-supply pump is configured to feed fuel at an overpressure of 5-10 bar.

10. A device according to claim 8, wherein said device further comprises a T-piece connected to the injector to connect high-pressure lines with the high-pressure fuel storage and/or the nozzle pre-chamber of a first injector and the T-piece of a further injector.

11. A device according to claim 8, wherein said device further comprises low-pressure lines for returning the flush volume to the pre-supply pump are provided.

12. A device according to claim 8, wherein said device further comprises a throttle and/or a control valve arranged in the branch line for controlling the flush volume.

13. A device according to claim 8, wherein said device further comprises a connection directly communicating with the control valve of the injector arranged on the injector for a further flush volume.

14. A device according to claim 8, wherein said device further comprises a non-return valve arranged in the branch line for the flush volume, wherein the control valve closes against a supply direction.

* * * * *